United States Patent [19]

Smith

[11] 4,295,404

[45] Oct. 20, 1981

[54] COMPENSATED NUT FOR A LUTE-TYPE INSTRUMENT

[75] Inventor: Paul R. Smith, Annapolis, Md.

[73] Assignee: DiMarzio Musical Instrument Pickups, Inc., N.Y.

[21] Appl. No.: 130,574

[22] Filed: Mar. 14, 1980

[51] Int. Cl.[3] ..... G10D 3/04

[52] U.S. Cl. ..... 84/314 N

[58] Field of Search ..... 84/314 R, 314 N

[56] References Cited

U.S. PATENT DOCUMENTS 652,353 6/1900 Edgren ..... 84/314 R 1,599,184 9/1926 Polychronis ..... 84/314 N 3,688,632 9/1972 Perez ..... 84/314 R

*Primary Examiner*—Lawrence R. Franklin

*Attorney, Agent, or Firm*—Auslander, Thomas & Morrison

[57] ABSTRACT

A nut to compensate for sharpness of notes, particularly near the neck of a lute-type instrument is provided with an extending portion extending over the fingerboard. The extension increases toward the bass notes. In a guitar, an excellent extension to compensate all the intermediate strings is from 1/64th of an inch at the treble end of the neck to 1/32nd of an inch at the bass end of the neck.

7 Claims, 5 Drawing Figures

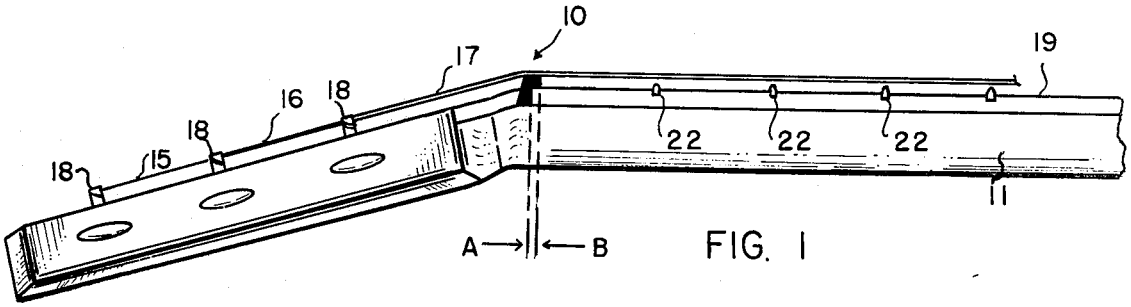
FIG. 1
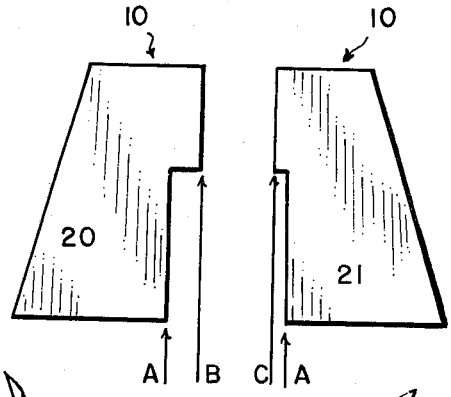
FIG. 2
FIG. 3
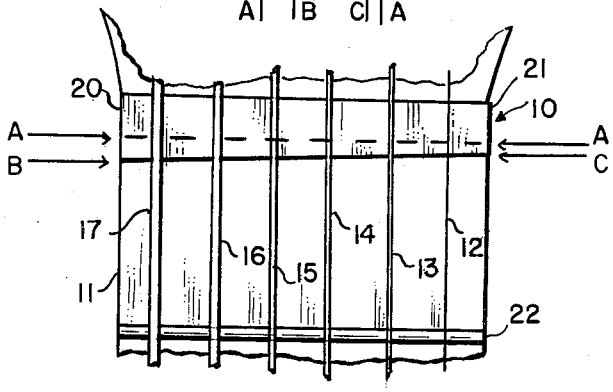
FIG. 4
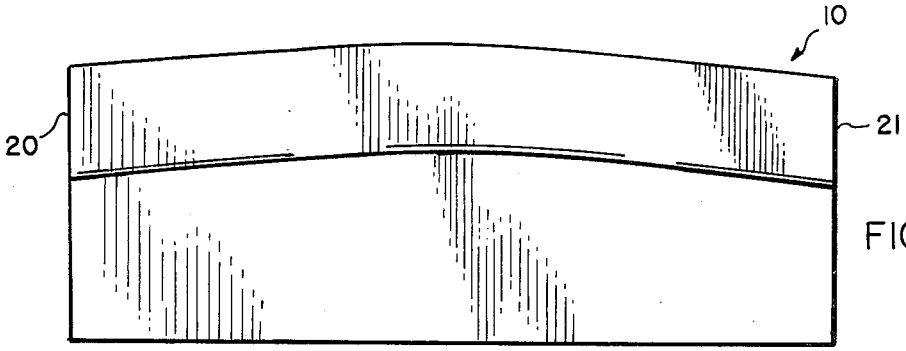
FIG. 5

COMPENSATED NUT FOR A LUTE-TYPE INSTRUMENT

The present invention relates to a compensated nut for a lute-type instrument.

True tone fidelity in lute-type instruments such as guitars, over the entire range of notes on any particular string, is difficult to achieve. This is generally true for most musical instruments. In lute-type instruments, tone is obtained as a function of many different factors, such as string length, tension and string diameter. The difficulties arise because factors in the physical construction of the strings affect its ability to vibrate. Stiffness, for instance, decreases the strings' vibration length, from the nut to the bridge, a sufficient trifle to sharpen the pitch of the played tone.

In the past, in lute-type instruments, compensation of the string has been provided at the bridge to extend the length of the strings, flattening their sharpness. In tuning, such compensation has usually obtained a desired pitch for the open string and its octave.

Each note along the fingerboard presents a slightly different situation as it is played. It has been found that in a lute-type instrument, even a bridge compensated string, which has been tuned, still tends to play sharp as notes are played near the end of the neck.

It has been found that compensation for the sharpness of notes, particularly near the first few frets, can be had by shortening the distance between the nut and the bridge. The lower pitch, wider diameter, strings, require more compensation, and such compensation also interacts with compensation already had at the bridge.

One method of the past for compensation has been to angulate the nut from a point along the fingerboard, the angulation increasing from treble to the bass strings. By so doing, the greater sharpness of the bass strings is compensated for by a greater shortening of the distance from bridge to nut, with an overall shortening of string length from bridge to nut to flatten the tone.

The problem with such adjustment is that it requires an alteration of the fingerboard, which makes the adjustment almost irreversible, or if not satisfactory, leaves a damaged instrument.

Another method of solving the problem has been to provide a complex set of individual adjustments for each string at the nut, the way bridges are compensated. The complexity and expense of such devices have kept them from any significant adoption.

According to the present invention, a nut is provided interchangable with the conventional nut of the lute-type instrument, which includes a portion extending over the fingerboard and angulated to give greater compensation to the strings of wider diameter as they are placed along the neck.

Provision of the extended portion provides the desired compensation without requiring any changes in the basic instrument or damage or alteration to the fingerboard.

It is also highly desirable to have the nut as rigid as possible, so as not to dampen the vibrations of the strings. It has been found that providing the nut of the present invention of a carbon fiber molded in plastic improves the nut and makes it very rigid.

Ideally, in a lute-type instrument such as a guitar, an extension of the nut of 1/64th of an inch over the first E string, graduated to an extension of 1/32nd of an inch over the sixth E string, provides satisfactory compensation. The overhang increases as the diameter of the string increases, thus the bass strings receive more compensation to compensate for their bulk and achieve the desired tone.

It should be understood that compensation is a compromise, since the perfect tuning of any particular note or string cannot at any time fully account for the different sets of circumstances involved with the playing of each individual note on the instrument.

In a preferred embodiment of the present invention, the nut comprises an elongated body, normally of a length to straddle the neck. The body abuts the fingerboard of the instrument. An extending portion of the body extends over the fingerboard, regularly graduated in extent, increasing from the treble side to the bass side of the neck of the instrument. The extent of distance is selected to be sufficient to compensate for sharpness of notes played near the neck.

The body portion of the nut may optionally be tapered to the top of the nut. It is preferable for the extending portion of the nut to override and rest upon the fingerboard. Experience has shown extensions graduating from 1/64th of an inch on the treble side of the neck to 1/32nd of an inch on the bass side of the neck satisfactorily compensate the intermediate strings.

Although such novel feature or features believed to be characteristic of the invention are pointed out in the claims, the invention and the manner in which it may be carried out may be further understood by reference to the description following and the accompanying drawings.

FIG. 1 is a partial view of the bass side of the neck of a lute-type instrument with a compensated nut of the present invention.

FIG. 2 is a detail of the nut as shown in FIG. 1.

FIG. 3 is an opposite end view of the nut as shown in FIG. 2.

FIG. 4 is a plan detail of a nut shown in FIG. 1.

FIG. 5 is a front elevation of the nut as shown in FIG. 4.

Referring now to the figures in greater detail, where like reference numbers denote like parts in the various figures.

The compensated nut 10 is shown in FIGS. 1 and 4 as it is placed on the neck of a lute-type instrument, exemplified by a guitar neck in the figures. As shown in FIG. 1 as seen from the bass side of the neck, the nut 10 is in position on the neck of the guitar. The strings 12, 13, 14, 15, 16, 17, are held on the tuning pegs 18 and extend over the nut 10 to the bridge and anchor points (not shown). The nut 10 extends from the end of the fingerboard 19 at line A to a position line B over the fingerboard 19, as can be seen in FIGS. 1 and 4. The overhang decreases from the bass end 20 of the nut 10 to the end 21 where the higher pitch strings (treble strings) rest.

The nut 10 as shown in the figures is not provided with slots, which may be provided for the strings to rest on in some nuts.

As shown in FIGS. 1 and 2 as applied to a guitar, the distance between lines A and B at the bass side of the neck 11, or the bass side 20 of the nut is 1/32nd of an inch. As shown in FIGS. 3 and 4, the distance between the lines A and C at the treble end 21 of the nut and the treble side of the nut 11 is 1/64th of an inch.

The nut 10 tapers from 1/64th of an inch to 1/32nd of an inch at the bass side.

By installing the nut 10 of the present invention substantially as nuts of the prior art are installed, the distance between the nut 10 and the frets 22 is reduced without any permanent change to the instrument neck or the fingerboard 19. Complicated adjustments such as complicated adjustments at the bridge are also avoided. The nut 10 of the present invention with its overhang avoids the necessity, for instance, of having to alter the fingerboard 19 to install an angulated nut, making the same compensation.

The terms and expressions which are employed are used as terms of description; it is recognized, though, that various modifications are possible.

It is also understood the following claims are intended to cover all of the generic and specific features of the invention herein described, and all statements of the scope of the invention which, as a matter of language, might fall therebetween.

Having described certain forms of the invention in some detail, what is claimed is:

1. A nut for a lute-type instrument said nut comprising an elongated body, said body normally having a length to straddle the neck of said instrument, said body normally adapted to abut the fingerboard of said instrument, and said body including an extending portion, said extending portion adapted to extend over said fingerboard, said extended portion regularly graduated in extent increasing from the treble side to the bass side of said neck, said extent of a selected distance adapted to compensate for sharpness of notes played near said neck.

2. The invention of claim 1 wherein said body is tapered to the top of the nut.

3. The invention of claim 1 wherein said extending portion abuts the top of said fingerboard.

4. The invention of claim 1 wherein said extending portion graduates outward from 1/64th of an inch at said treble side of said neck.

5. The invention of claim 4 wherein said extending portion graduates inward from 1/32nd of an inch at the bass side of said neck.

6. The invention of claim 1 wherein said extending portion graduates inward from 1/32nd of an inch at the bass side of said neck.

7. The invention claims 1, 2, 3, 4, 5, or 6 wherein said nut comprises a carbon fiber impregnated in plastic.

* * * * *